US006477738B1

(12) United States Patent
Kremer et al.

(10) Patent No.: US 6,477,738 B1
(45) Date of Patent: Nov. 12, 2002

(54) DOOR STOP STRUCTURALLY COMBINED WITH A DEMOUNTABLE DOOR HINGE

(75) Inventors: Johannes Kremer, Remscheid (DE); Nils Magnus, Remscheid (DE)

(73) Assignee: Ed. Scharwaechter GmbH, Remscheid (DE)

( * ) Notice: Subject to any disclaimer, the term of this patent is extended or adjusted under 35 U.S.C. 154(b) by 0 days.

(21) Appl. No.: 09/647,495

(22) PCT Filed: Jan. 28, 1999

(86) PCT No.: PCT/DE99/00259

§ 371 (c)(1),
(2), (4) Date: Feb. 1, 2001

(87) PCT Pub. No.: WO99/51845

PCT Pub. Date: Oct. 14, 1999

(30) Foreign Application Priority Data

Apr. 1, 1998 (DE) ..... 198 14 593

(51) Int. Cl.[7] ..... E05C 17/64
(52) U.S. Cl. ..... 16/342; 16/386; 296/146.11
(58) Field of Search ..... 16/342, 337, 333, 16/386, 82, 374, 376; 296/146.11, 146.12, 202

(56) References Cited

U.S. PATENT DOCUMENTS

| | | | | |
|---|---|---|---|---|
| 4,800,623 A | * | 1/1989 | Brockhaus | 16/254 |
| 4,829,633 A | * | 5/1989 | Kassner | 16/340 |
| 5,173,993 A | * | 12/1992 | Baker | 16/340 |
| 5,761,769 A | | 6/1998 | Brueckner | 16/342 |
| 5,878,463 A | * | 3/1999 | Klüting et al. | 16/322 |
| 5,920,960 A | * | 7/1999 | Klüting | 16/322 |

FOREIGN PATENT DOCUMENTS

| | | |
|---|---|---|
| DE | 19600063 | 5/1997 |
| DE | 19633462 | 2/1998 |
| FR | 7329346 | 10/1973 |
| FR | 2670530 | 6/1992 |

* cited by examiner

*Primary Examiner*—Chuck Y. Mah
*Assistant Examiner*—Doug Hutton
(74) *Attorney, Agent, or Firm*—Davidson, Davidson & Kappel, LLC

(57) ABSTRACT

The invention relates to a door stop for motor vehicle doors which is integrated with a demountable door hinge. The door hinge is comprised of two hinge halves (1, 2) and a hinge pin (3) which is accommodated in hinge half (2) with a running fit and in the other hinge half (1) such that it can be lifted off without turning. The door stop comprises braking or holding means which are radially aligned in relation to the hinge pin axis and which interact with stopping means concentrically arranged in relation to the hinge pin axis. The door stop assembly is primarily accommodated in a door stop housing (12). Said door stop housing is placed, in an axial projection (11) of the hinge axis. The hinge pin is mounted with a running fit in the hinge half (2). According to the invention, the hinge pin (3) is connected to a complementary non-circular form of the inner peripheral wall of the door stop housing (12) which is connected to the respective hinge half (2) whose knuckle intersperses the hinge pin with bearing clearance. Said hinge pin comprises a curvature contour of the cross-section thereof, said contour deviating from the pure circular form, over at least part of the longitudinal area (11) of the hinge pin which engages inside the door stop housing (12).

16 Claims, 4 Drawing Sheets

DOOR STOP STRUCTURALLY COMBINED WITH A DEMOUNTABLE DOOR HINGE

FIELD OF THE INVENTION

The invention relates to a door stop structurally combined with a demountable door hinge for motor-vehicle doors, the door hinge comprising a first hinge half which can act upon the one door assembly part, door or pillar, and a second hinge half which can act upon the other door assembly part, and also a hinge pin which is held in the one hinge half with a running fit and in the other hinge half in a manner such that it can be lifted off in a rotationally secure manner, and the door stop comprising braking or holding means which are arranged aligned radially with respect to the hinge-pin axis and which interact with abutment means arranged concentrically with respect to the hinge-pin axis, and being accommodated in its entirety in a door stop housing which is placed, in an axial extension of the hinge axis, onto that hinge half in which the hinge pin is mounted with a running fit.

BACKGROUND INFORMATION

Although door stops of this type which are structurally combined with a door hinge are distinguished by a comparatively small installation space requirement and can also be implemented in a multiplicity of embodiments modified to a greater or lesser extent, they still require, in order to produce them, a considerable number of individual parts which have to be produced and fitted separately. Door stops of this type are therefore basically afflicted with a production outlay which is still excessively high and at the same time with certain uncertainties with regard to specified holding positions of the door always being maintained. Moreover, the result of the number of components required overall for the door stop is that there is an increase in the probability of encountering unfavourable tolerance pairings and therefore, obviously, the increased production of sources of noise which can be attributed to unfavourable tolerance pairings within the door stop. Finally, the multiplicity of individual components requires corresponding stock-keeping both at the manufacturer and for the stock-keeping of spare parts.

However, the disadvantage of it not being possible to standardize the door stop and its component is particularly serious.

Furthermore, motor-vehicle door hinges having an integrated door stop have also already been become known to the effect that the hinge pin, which consists of solid material, of the hinge formed from a first and a second hinge half is secured non-rotatably in the gudgeon of the one hinge half and is held in the gudgeon of the other hinge half in such a manner that it passes through the at least one gudgeon with a bearing clearance. In conjunction with such a design of the hinge, the configuration of the integrated door stop is distinguished by the hinge pin, together with a complementary formation of the gudgeon hole of at least one gudgeon of that hinge half through whose gudgeon it passes with bearing clearance, having, at least over a part of its length region or regions assigned to one or each of these gudgeons, a rounded profile of its cross section, which profile deviates from the pure circular shape. Although such door-braking and stopping devices integrated in a door hinge are distinguished by an extremely small installation space requirement and also only require a minimum number of individual parts, they are afflicted with the disadvantage that the machining of the hinge half through whose gudgeon the hinge pin passes with bearing clearance is extremely complicated.

The present invention is therefore based on the object of improving a door stop which is structurally combined with a demountable door hinge and is intended for motor-vehicle doors of the type mentioned at the beginning to the effect that the production of the stop unit, regardless of the door stop running in an as noiseless manner as possible is improved sufficiently such that with the smallest number of individual parts standardization at least of some of the components of the door stop and in addition a more cost-effective hinge stop unit are obtained.

According to the present invention, this object may be achieved in that the hinge pin, together with a complementary noncircular form of the inner circumferential wall of the door stop housing which is connected to that hinge half through whose gudgeon it passes with bearing clearance has, at least over a part of its length region which engages in the door stop housing, a rounded profile of its cross section, which profile deviates from the pure circular form. In this case, in order to save on complicated shaping, the door stop housing is advantageously formed by a length section of a continuous hollow-profile material and is secured via positive-locking means in a rotationally secure manner on the outer joint surface of that hinge half through whose gudgeon the hinge pin passes with bearing clearance. The door stop housing is expediently secured on the hinge half by way of a mutual, positive-locking engagement, particularly in a manner such that the door stop housing is connected, by means of at least one axial extension of its circumferential wall, in a positive-locking manner to a correspondingly configured recess in that hinge half through whose gudgeon the hinge pin passes with bearing clearance.

However, in a modified design form of the mutual, positive-locking engagement of the door stop housing and hinge half, provision may also be made for the door stop housing to have an end toothing which interacts with a complementarily designed toothing in the outer joint surface of that hinge half through whose gudgeon the hinge pin passes with bearing clearance.

Regardless of how the mutual, positive-locking engagement of the door stop housing and hinge half may be considered in detail, an advantageous fastening form is one wherein the door stop housing, which is formed by a length section of a continuous hollow-profile material, is held in the positive-locking engagement with the mating profiling on or in the hinge half by means of an abutment washer which rests on a free end of the door stop housing and is supported against the hinge pin in the axial direction. Furthermore, in a development of the fastening or connection of the door stop housing to the hinge half, provision may also be made for the end side of the door stop housing on this side, which is provided with at least one axial projection or an end profiling, to be sealed with respect to the surface of the hinge half by means of a sealing means.

With regard to the design of the braking and holding means of the door stop, a simple but effective embodiment results from the fact that the inner circumferential surface of the door stop housing and the outer circumferential surface of that length region of the hinge pin which reaches through the door stop housing each merely have a rounded deviation in its circumferential surface which protrudes with respect to the cylindrical shape. However, in most applications it will be necessary to fit the door stop with a plurality of braking and holding positions, to which end provision may then be made for the hinge pin to have, spaced apart from each other over its circumference, two deviations from the exactly circular cross-sectional shape, which deviations protrude radially with respect to the circular shape, the two diameter deviations, which protrude radially with respect to the circular shape, of the hinge pin being arranged such that they lie opposite each other.

Depending on the position of the intended braking and holding positions of the motor-vehicle door, with regard to the allocation of the braking and holding means provision may be made for the straight line which intersects the highest points of the mutually opposite, radially protruding rounded deviations of the hinge pin to form 90° with respect to the straight line passing through the location of the stop and of the hinge tap.

However, provision may also be made, corresponding to the intended arrangement, for the highest points of the two radially protruding rounded deviations of the hinge pin to be arranged aligned at an angle with respect to one other.

Finally, provision may also be made for the inner circumferential surface of the door stop housing and/or that length section of the hinge pin which engages in said housing to be provided either with a sliding coating or else with an edge-layer hardening.

BRIEF DESCRIPTION OF THE DRAWINGS

The present is described in detail in the following description of the examples with reference to an exemplary embodiment, illustrated in the drawing, of the preferred implementation form. In the drawing

DETAILED DESCRIPTION OF A PREFERRED EMBODIMENT

Figure 1:
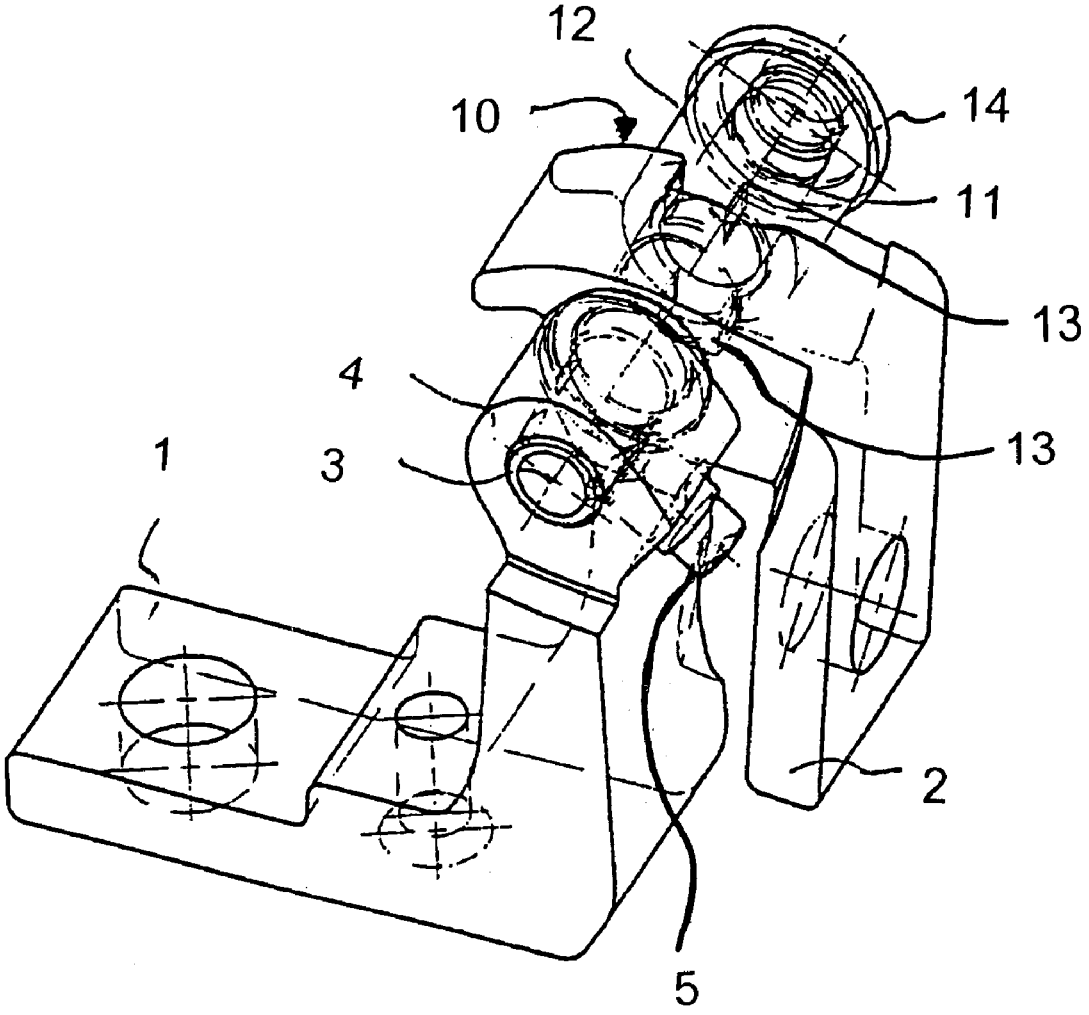
FIG. 1 shows a schematic and graphical illustration of a door stop structurally combined with a demountable door hinge.
Figure 4:
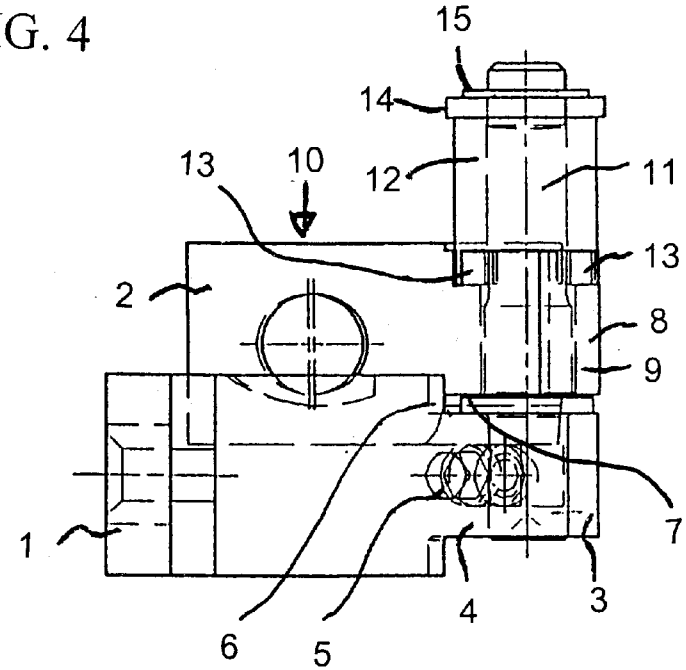
FIG. 4 shows a side view of the subassembly of the door stop and demountable door hinge.
Figure 2:
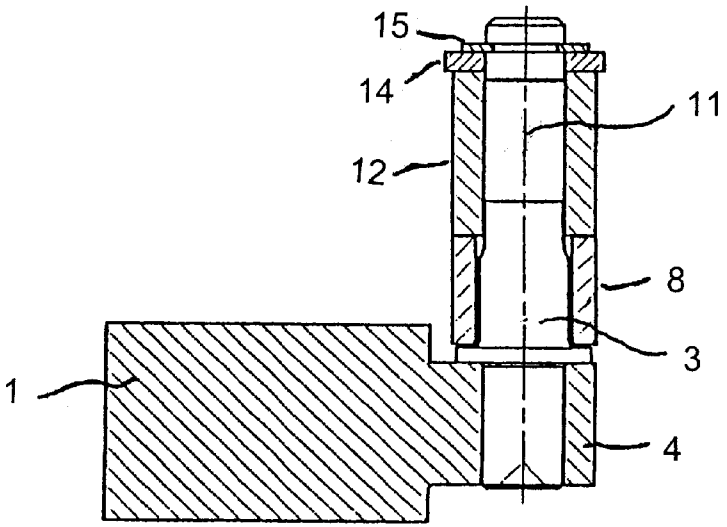
FIG. 2 shows a longitudinal section through a demountable door hinge, which is structurally combined with a door stop, for motor-vehicle doors.
Figure 3:
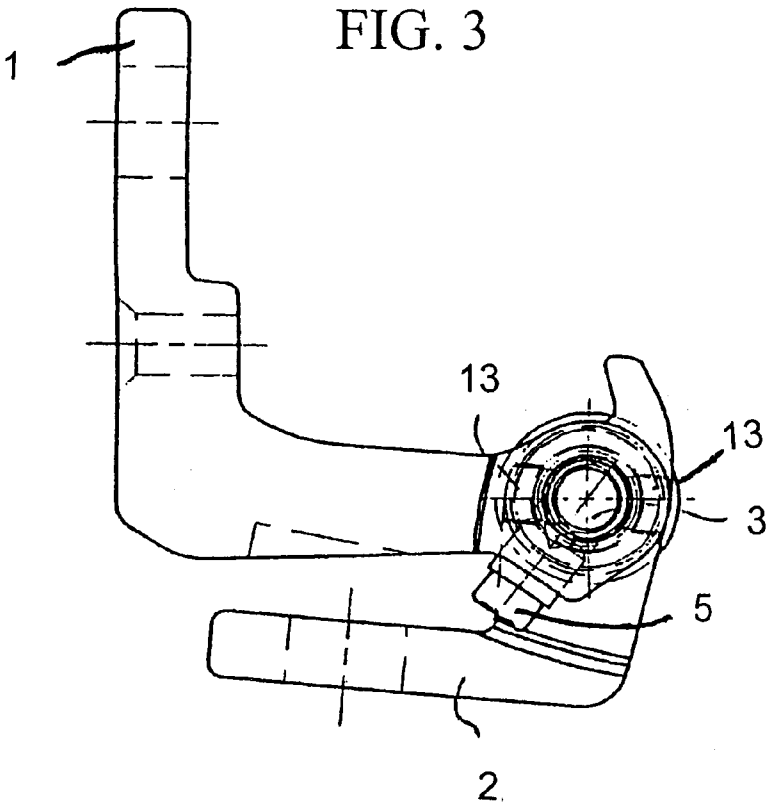
FIG. 3 shows a plan view of the subassembly of the door stop and demountable door hinge.
Figure 5:
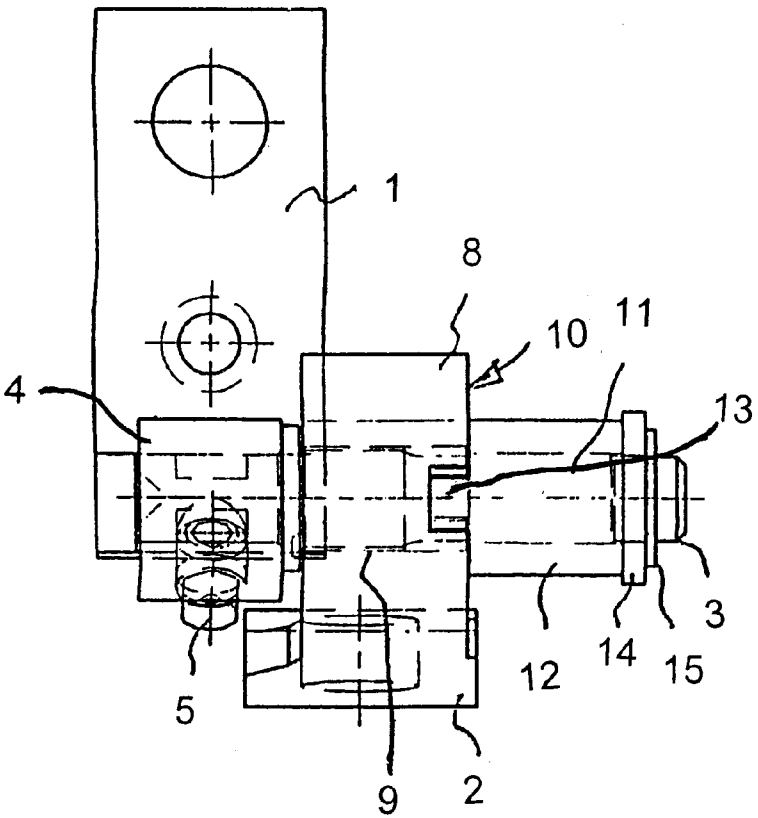
FIG. 5 shows an end view of the subassembly of the door stop and demountable door hinge.
Figure 6:
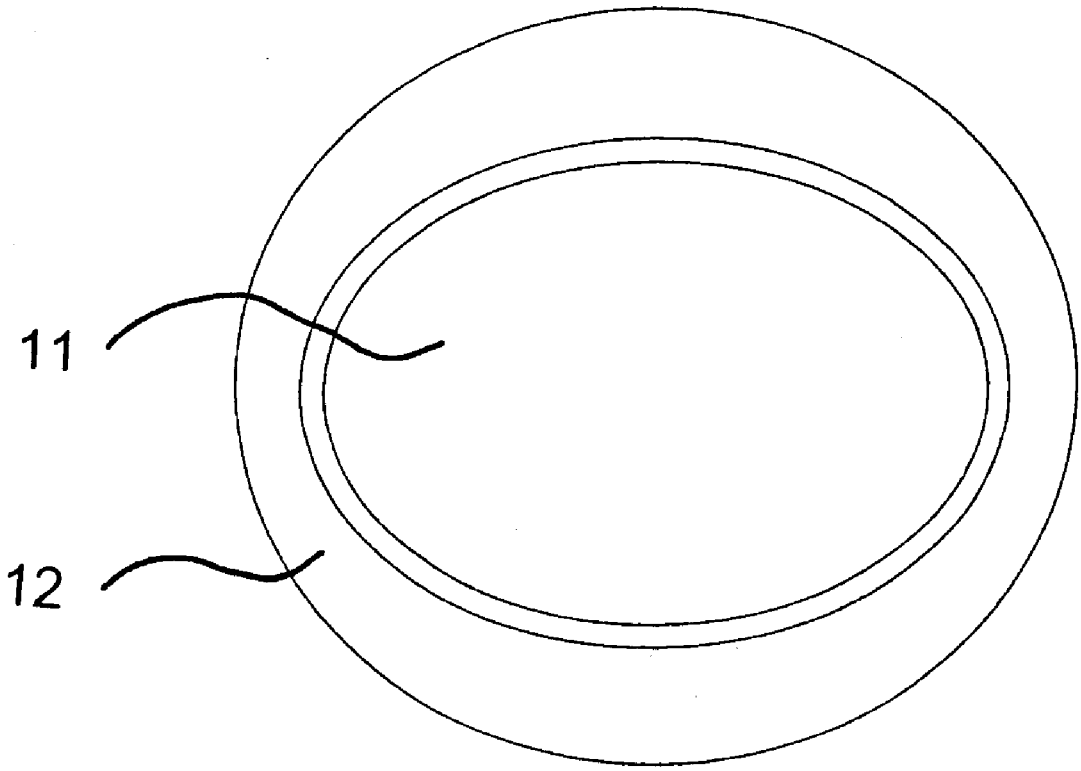
FIG. 6 shows schematically a cross-sectional view through the length section and the stop housing.

As shown in FIGS. 1 through 5, the demountable door hinge comprises a first hinge half 1, which can act on the one door assembly part, which is not illustrated in greater detail in the drawing, and a second hinge half 2, which acts on the other door assembly part, which is likewise not illustrated in greater detail in the drawing, and also a hinge pin 3 which pivotably connects the two hinge halves 1 and 2 to each other. In the gudgeon 4 of the first hinge half 1 the hinge pin 3 is secured in a rotationally secure manner by means of an interference fit and a radial screw 5.

The hinge pin 3 has a radially protruding collar 6 with which it fits over the inner joint side 7 of the hinge half 1.

In the gudgeon 8 of the second hinge half 2 the hinge pin 3 is mounted with a running fit in a freely rotatable manner by means of a bearing bushing 9 made of maintenance-free bearing material.

The hinge pin 3 has a length section 11 which protrudes over the outer joint side 10 of the second hinge half 2 and with which it reaches through a door stop housing 12. In the embodiment illustrated, the door stop housing 12 consists of a length section of a continuous hollow-profile material and is in positive-locking engagement with the second hinge half 2. In the embodiment shown, the door stop housing 12 has a cylindrical outer circumferential surface and on its end side which faces the outer joint surface 10 of the second hinge half 2 is provided with two projections 13 which are arranged opposite each other, are directed axially and which are assigned complementary recesses 14 in the circumference of the gudgeon 8 in such a manner that the door stop housing 12 is coupled in a positive-locking and rotationally secure manner to the hinge half 2. The door stop housing 12 is held in engagement with the outer joint surface 10 of the second hinge half 2 and also with the recesses 14 in the circumference of the gudgeon 8 by means of a washer 15 which fits over its outer end side and is supported in the axial direction against the length section 11 of the hinge pin 3. In this case, the washer 15 is held by means of a snap ring which engages in a circumferential groove of the length section 11 of the hinge pin 3.

What is claimed is:

1. A door stop for motor-vehicle doors, comprising:

a door hinge being structurally combined in said door stop, wherein said door hinge comprises a first hinge half which can act upon a first of a door and a door pillar, a second hinge half which can act upon the other of said door and said door pillar, and a hinge pin defining a hinge pin axis, the hinge pin being held in one of said first and second hinge halves with a running fit and in the other of said first and second hinge halves in a rotationally secure manner, wherein said other of said first and second hinge halves can be lifted off, a door stop housing arranged in an axial extension of the hinge and having an inner circumferential wall concentric to said hinge pin axis, said door stop housing being placed onto said one of said first and second hinge halves, wherein a length region of the hinge pin engages into said door stop housing, said length region having a cross section with rounded profile deviating at least partially from a pure circular form by radially protruding deviations, and wherein the inner circumferential wall of the door stop housing has a noncircular form complementary to the cross section of the length region of the hinge pin.

2. The door stop according to claim 1, wherein the door stop housing is formed by a length section of a continuous hollow-profile material, and wherein the door stop housing is positive-lockingly secured in a rotationally secure manner on an outer joint surface of said one of said first and second hinge halves.

3. The door stop according to claim 2, wherein the door stop housing has an end toothing which interacts with a complementary designed toothing in the outer joint surface of said one of said first and second hinge halves.

4. The door stop according to claim 1, wherein the door stop housing is connected, by means of at least one axial extension of its circumferential wall, in a positive-locking manner to a correspondingly configured recess in of said one of said first and second hinge halves.

5. The door stop according to claim 1, wherein a largest, radially protruding rounded deviation from the pure circular shape in the cross-sectional shape of the length section of the hinge pin is within the range of between some hundredths and approximately one tenth of the general hinge-pin diameter.

6. The door stop according to claim 1, wherein the door stop housing is held in positive-locking engagement with a mating profiling on or in said one of said first and second hinge halves by means of an abutment washer which rests on a free end of the door stop housing and is supported against the hinge pin in an axial direction.

7. The door stop according to claim 1, wherein a sealing element is provided between the door stop housing and said one of said first and second hinge halves.

8. The door stop according to claim 1, wherein the inner circumferential wall of the door stop housing and the outer circumferential surface of said length region of said hinge pin each merely have a rounded deviation in their respective circumferential surface which protrudes with respect to a cylindrical shape.

9. The door stop according to claim 1, wherein the hinge pin has, spaced apart from each other over its circumference, two deviations from the exactly circular cross-sectional shape, which deviations protrude radially with respect to the circular shape.

10. The door stop according to claim 9, wherein said two diameter deviations are arranged such that they lie opposite each other.

11. The door stop according to claim 9, wherein a straight line which intersects the highest points of said two diameter deviations shows an angle of 90° with respect another straight line defined by the fixing location of one of said first and second hinge halves to one of said door and said door pillar.

12. The door stop according to claim 9, wherein the highest points of said two diameter deviations are arranged aligned at an angle with respect to one another.

13. The door stop according to claim 1, wherein the inner circumferential surface of the door stop housing is fitted with a sliding coating.

14. The door stop according to claim 13, wherein the length section of the hinge pin which engages in said door stop housing is fitted with a sliding coating.

15. The door stop according to claim 1, wherein the inner circumferential surface of the door stop housing is provided with an edge-layer hardening.

16. The door stop according to claim 1, wherein the length section of the hinge pin which engages in said door stop housing is provided with an edge-layer hardening.

* * * * *